US005116277A

United States Patent [19]

Kelley

[11] Patent Number: 5,116,277

[45] Date of Patent: May 26, 1992

[54] DOLL HAVING VARIABLE LENGTH HAIR SEGMENT

[76] Inventor: William J. Kelley, 4721 Laurette St., Torrance, Calif. 90503

[21] Appl. No.: 702,216

[22] Filed: May 17, 1991

[51] Int. Cl.[5] ..... A63H 3/44; A63H 13/02

[52] U.S. Cl. ..... 446/319; 446/296

[58] Field of Search ..... 446/319, 320, 321, 268, 446/372, 391, 394, 296, 295

[56] References Cited

U.S. PATENT DOCUMENTS

| | | | |
|---|---|---|---|
| 3,116,954 | 1/1964 | Orenstein | 446/296 X |
| 3,156,999 | 11/1964 | Dean et al. | 446/319 |
| 3,162,976 | 12/1964 | Beebe et al. | 446/319 |
| 3,477,170 | 11/1969 | Lilienstern | 446/319 |
| 3,670,451 | 6/1972 | Groves et al. | 446/319 |
| 3,694,957 | 10/1972 | Houghton | 446/319 |
| 3,696,552 | 10/1972 | Gunther et al. | 446/319 |
| 3,698,134 | 10/1972 | Amici et al. | 446/319 |
| 3,808,736 | 5/1974 | Terzian et al. | 446/296 |
| 3,828,467 | 8/1974 | Kaelin | 446/320 |
| 3,834,071 | 9/1974 | Terzian et al. | 446/353 |
| 4,801,286 | 1/1989 | Orenstein et al. | 446/319 |
| 4,917,647 | 4/1990 | Wetherell et al. | 446/268 X |

FOREIGN PATENT DOCUMENTS

| | | | |
|---|---|---|---|
| 693746 | 9/1964 | Canada | 446/319 |
| 1038964 | 9/1958 | Fed. Rep. of Germany | 446/394 |
| 2508812 | 1/1983 | France | 446/319 |
| 2199761 | 7/1988 | United Kingdom | 446/320 |

*Primary Examiner*—Robert A. Hafer
*Assistant Examiner*—D. Noel Muir
*Attorney, Agent, or Firm*—Roy A. Ekstrand

[57] ABSTRACT

A doll includes a hollow head and torso joined at the neck. The head supports a quantity of conventionally rooted simulated hair and defines a center aperture in the top portion thereof. The torso defines an internal laterally extending post and an aperture positioned on the upper rear torso. A length of simulated hair defines a fixed end secured to the doll's head and extending downwardly through the head and torso and upwardly and outwardly through the centrally located aperture and terminates in a free end. A ring encircles the intermediate loop formed in the adjustable hair segment within the torso interior and a flexible ribbon is coupled to the ring and passes beneath the laterally extending post and upwardly and outwardly through the aperture on the rear torso's surface. A conventional comb is secured to the remaining external end of the flexible ribbon. The hair length of the adjustable hair segment may be drawn inwardly for shorter length by withdrawing the flexible ribbon from the torso or, alternatively, may be drawn outwardly from the head to produce an increased length of adjsutable hair segment.

14 Claims, 2 Drawing Sheets

DOLL HAVING VARIABLE LENGTH HAIR SEGMENT

FIELD OF THE INVENTION

This invention relates to dolls and toy figures and particularly to those which provide variable length hair locks or hair segments.

BACKGROUND OF THE INVENTION

Many dolls and toy figures have been provided through the years which have simulated heads or locks of hair. Such simulated hair is usually formed of multiple strands of vinyl or plastic material or the like and is generally rooted or secured to the doll or toy figure's scalp. Children have responded very favorably to such dolls and, have for many years, enjoyed various activities in connection with the simulated hair such as combing, styling, washing, cutting and so on. To further enhance the play value and enjoyment of such dolls having simulated hair, practitioners in the art began providing dolls having adjustable or variable hair lengths. Typically, such adjustable or variable hair lengths for dolls were provided to simulate growth and cutting cycles as well as to permit a greater variety of alternative hairstyles to be used.

Such variable length dolls have been well received and, as a result, practitioners in the art have created a great variety of mechanisms which operate to vary or permit changes to the lengths of simulated doll hair on a doll or toy figure.

For example, U.S. Pat. No. 3,808,736 issued to Terzian, et al. sets forth HAIRSTYLING FIGURE AND ACCESSORIES in which a doll or simulated figure includes a simulated head having a skull portion with head embedded therein or fixed thereto. A centrally located aperture in the top portion of the doll head is provided. An elongated tuft of simulated hair extends through the aperture and is removably secured to the doll's skull. A plurality of interchangeable accessory hair pieces are provided.

U.S. Pat. No. 3,698,134 issued to Amici, et al. sets forth a DOLL HAVING ADJUSTABLE LOCK OF HAIR in which a doll or toy figure defines a hollow head portion having a central aperture in the top portion thereof. A rotatable spindle is supported within the doll torso and includes a reel to which a length of cord or the like is secured and rollable thereon. The remaining end of the cord is secured to a lock of simulated hair within the doll interior and the length of hair of adjusted by rotating the spindle and winding the cord.

U.S. Pat. No. 3,156,999 issued to Dean, et al. sets forth a HAIR DISPENSING HOLDER FOR DOLL'S HEAD in which a doll or toy figure defines a head cavity having hair secured thereto. The doll head defines an opening which receives a hair lock holder. A plurality of hair lock holders are provided which bear a lock of hair and which are securable to the doll's head.

U.S. Pat. No. 3,162,976 issued to Beebe, et al. sets forth a DOLL, TOY FIGURE AND THE LIKE WITH AN ADJUSTABLE LOCK OF HAIR in which a doll or toy figure includes a hollow head and torso. An aperture defined in the doll head receives an elongated hair lock having a flexible core tied thereto. A rotatable reel is supported within the torso body and is secured to the remaining end of the flexible cord.

Rotation of the reel winds the cord upon the reel and draws the hair lock into the doll head to shorten it.

U.S. Pat. No. 3,477,170 issued to Lilienstern sets forth a RETRACTABLE HAIR DOLL in which a doll includes a hollow head and torso and defines a centrally disposed aperture in the top portion of the doll head. An elongated lock of simulated hairs pass through the head aperture and is tied to a flexible cord at one end. The cord extends through the doll torso and is coupled to alternative take-up mechanisms such as an elongated spring or weight.

U.S. Pat. No. 3,670,451 issued to Groves, et al. sets forth an ADJUSTABLE HAIR DOLL in which a doll or toy figure includes a hollow head and torso and defines an upper aperture in the head portion. A lock of simulated hair is passed through the aperture and tied to one end of a flexible cord. A spring driven winding mechanism is coupled to the remaining end of the cord and is wound by drawing the adjustable simulated hair lock outwardly from the doll's skull. The winding mechanism is released by pressure upon the torso causing it to rewind and draw the adjustable hair lock back into the doll's head and torso.

U.S. Pat. No. 3,694,957 issued to Houghton sets forth a HAIR GROWING DOLL having a hollow head and torso and defining a top center aperture in the head portion. An elongated lock of hair is passed through the aperture and the inner end thereof is secured by a resilient member to the doll interior. A push button actuated lock mechanism releasibly captivates the hair lock and maintains it at any desired position.

U.S. Pat. No. 3,834,071 issed to Terzian, et al. sets forth a DOLL WITH COORDINATED HEAD AND TORSO MOVEMENT which includes an upper torso and lower torso rotatably coupled and a hollow head defining a center aperture in the top portion thereof. A motor supported in the lower torso portion is coupled to the upper torso causing motion thereof. A drawstring mechanism is operatively coupled to the motor drive and supports a length of flexible cord wound thereon. The flexible drawstring cord is secured to the inner end of a hair lock passing through the aperture in the head. The operation of the motor drive causes the hair lock to be drawn into the doll head.

U.S. Pat. No. 4,801,286 issued to Orenstein, sets forth a DOLL WITH SIMULATED HAIR GROWTH in which a doll includes a hollow head defining a center aperture therein. An elongated lock of simulated hair is passed through the aperture and an advancing mechanism is coupled to the hair lock and to one or more of the doll appendages such that motion of the appendages causes the hair lock to be drawn into the doll head.

While the foregoing described prior art devices have provided a variety of hair length adjustment for dolls and toy figures, there remains a continuing need in the art for evermore improved and entertaining variable length hair dolls and toy figures.

SUMMARY OF THE INVENTION

Accordingly, it is a general object of the present invention to provide an improved doll or toy figure. It is a more particular object of the present invention to provide an improved doll or toy figure having a variable length hair segment. It is a still more particular object of the present invention to provide an improved doll or toy figure having a variable length hair segment and improved mechanism for providing the same In accordance with the present invention, there is provided a doll having a variable length hair segment, said doll comprises: a doll body including a hollow head defining a first aperture therein and a hollow torso and the body defining a second aperture therein; a hair segment having a first end secured in a fixed attachment to the doll body, a second end external to the doll body and an intermediate portion within the hollow head and torso extending from the fixed first end through the first aperture; and a flexible draw member having a first end coupled to the intermediate portion of the hair segment extending outwardly from the doll body through the second aperture therein and defining a second end, the flexible draw member being withdrawable from the doll body to increase the length of the intermediate portion of the hair segment and decrease the length of the second end of the hair segment external to the doll body.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
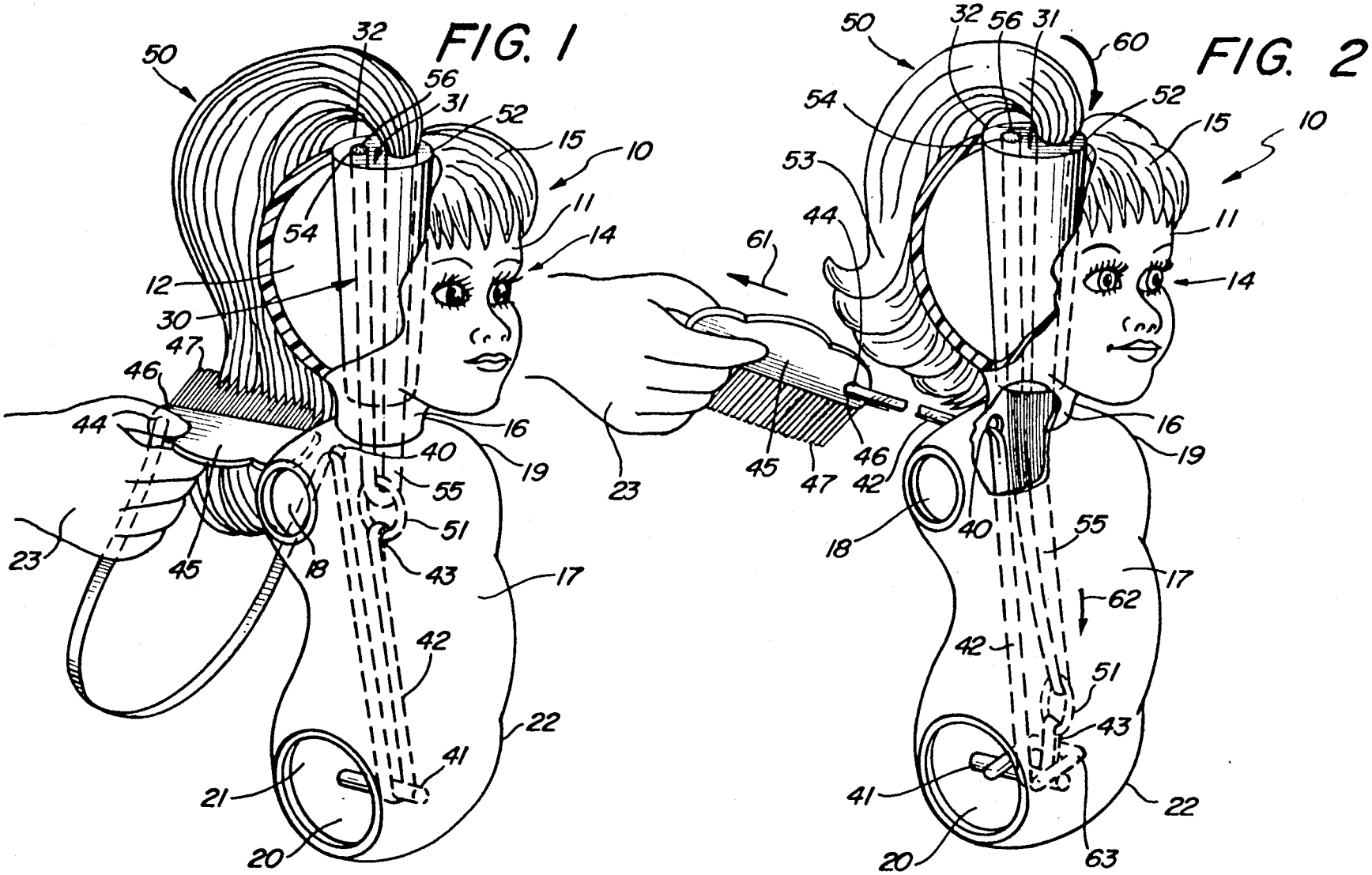
FIG. 1 sets forth a perspective view of a doll torso and head constructed in accordance with the present invention.
FIG. 2 sets forth a perspective view of a doll torso and head constructed in accordance with the present invention and showing an alternative head configuration.

FIG. 1 sets forth a perspective view of a doll constructed in accordance with the present invention and generally referenced by numeral 10. Doll 10 includes a hollow head 11 defining an interior cavity 12 and an aperture 52 therein. Head 11 further defines a face 14 and a downwardly extending neck 16. A quantity of simulated hair 15 is rooted to the upper portion of doll head 11 in accordance with conventional fabrication techniques. A generally cylindrical head support 30 defines a wall portion 32 and a center passage 31. Head support 30 is received within interior cavity 12 of head 11 and is received within neck 16 to provide support for the portion of the top portion of head 11 and particularly the portion thereof surrounding apertures 52 and 54.

Doll 10 further includes a hollow torso 17 defining an interior cavity 21. Torso 17, in accordance with conventional fabrication techniques, defines a pair of shoulder sockets 18 and 19 and a pair of hip sockets 20 and 22 (the latter not seen). Torso 17 further defines an aperture 40 located upon the back surface of torso 17 below neck 16.

An elongated adjustable hair lock 50, preferably formed of a simulated synthetic hair material, defines a free end 53 and a fixed end 56. In accordance with the present invention, hair lock 50 passes downwardly through aperture 52 to the interior of head support 30 and interior cavity 12 of head 11. A portion of hair lock 11 forms a downwardly extending loop portion 55 which is received within head 11, neck 16 and interior cavity 21 of torso 17. The remaining end of hair lock 50 forms a fixed end 56 which is received within aperture 54 of head 11 and secured thereto by a conventional attachment such as conventional hair rooting. Alternatively, fixed end 56 may be mechanically fastened to head 11 or secured thereof by other attachment methods such as adhesives or the like without departing from the spirit and scope of the present invention. A ring 51 encircles the intermediate portion of hair loop 55 between aperture 52 and fixed end 56. An elongated flexible ribbon 42 defines an end loop 43 coupled to ring 51 at one end. Flexible ribbon 42 extends downwardly through interior cavity 21 of torso 17 from end loop 43 and passes about a cylindrical post 41 supported in a general horizontal orientation within interior cavity 21 of torso 17. Flexible ribbon 42 then extends upwardly through interior cavity 21 of torso 17 and outwardly through aperture 40 on the rear surface of torso 17. The remaining portion of flexible ribbon 42 extends loosely from aperture 40 and terminates in an end portion 44. A comb 45 defines a plurality of closely spaced teeth 47 and an aperture 46. End 44 of flexible ribbon 42 is secured to comb 45 at aperture 46.

In the position shown in FIG. 1, doll 10 is configured to permit hairstyling of hair 15 and adjustable hair lock 50. In accordance with the anticipated use of the present invention, a user's hands 23 is shown holding comb 45 and is in the process of combing or stying free end 53 of adjustable hair lock 50. When so used, the intermediate portion of flexible ribbon 42 extending from ring 51 downwardly about post 41 and upwardly and out through aperture 40 and therefrom secured to comb 45 is generally slack and no significant force is applied to adjustable hair lock 50. Thus, the residual friction between hair lock 50 and aperture 52 tends to maintain adjustable hair lock 50 in the position shown. However, it may be desirable to draw additional hair out from the interior of torso 17 and head 11 during the styling process. This additional hair may be drawn outwardly in the manner shown in FIG. 3 in which adjustable hair lock 50 is grasped and pulled outwardly from head 11. During this process, ring 51 provides a stop limit upon the extent to which adjustable hair lock 50 may be withdrawn from head 11. Thus, the user may continue to style adjustable hair lock 50 in the desired manner shown in FIG. 1 until the desired appearance is received.

FIG. 2 sets forth a partially sectioned perspective view of doll 10 showing the operation of drawing a substantial portion of adjustable hair lock 50 into the interior of doll 10. As mentioned above, doll 10 includes a head 11 defining a face 14, an aperture 52, an aperture 54 and a neck 16. Doll 10 further includes a torso 17 defining an interior cavity 21 and a plurality of appendage sockets 18, 19, 20 and 22. A post 41 is horizontally positioned within interior cavity 21 and an aperture 40 is defined in the rear upper portion of torso 17. A generally cylindrical head support 30 defines a cylindrical wall 32 and a passage 31 therethrough. Support 30 is positioned between neck 16 and the upper portion of head 11 and encircles the portion of head 11 defining apertures 52 and 54. An adjustable hair lock 50 defines a free end 53 and an intermediate portion extending downwardly through aperture 52 of head 11 forming a loop within torso 17 and a fixed end 56 which is received within and secured to aperture 54. A ring 51 encircles the intermediate portion of hair lock 50 and is coupled to end loop 43 of flexible ribbon 42. The latter winds beneath post 41 and passes outwardly through aperture 40 and is coupled to comb 45 at aperture 46.

In operation, the length of adjustable hair lock 50 may be reduced from the extension shown in FIG. 1 and, in accordance with an important aspect of the present invention, by the user grasping comb 45 with hand 23 and thereafter drawing flexible ribbon 42 outwardly from torso 17 through aperture 40 in the direction indicated by arrow 61. As flexible ribbon 42 is drawn outwardly in the direction of arrow 61, ring 51 is pulled downwardly within interior cavity 21 of torso 17 in the direction indicated by arrow 62. In its preferred form, post 41 is positioned within interior cavity 21 such that ring 51 is not capable of passing around post 41. Thus, ring 51 and post 41 cooperate to provide a limit stop on the extension of flexible ribbon 42 outwardly through aperture 40. This in turn limits the minimum length of adjustable hair lock 50 which extends outwardly through aperture 52. In the alternative, a physical stop member may be positioned adjacent post 41 such as stop member 63 to keep ring 51 from passing about post 41.

In any event, the outward pull of hand 23 upon comb 45 drawing flexible ribbon 42 outwardly through aperture 40 in the direction of arrow 61 and pulling ring 51 downwardly in the direction of arrow 62 increases the length of the intermediate portion of adjustable hair lock 50 between fixed end 56 and aperture 52. Thus, an additional portion of adjustable hair lock 50 is pulled downwardly into the interior of head 11 and torso 17 through aperture 52 in the direction indicated by arrow 60. Thus, comparison of FIGS. 1 and 2 shows that the length of adjsutable hair lock 50 forming free end 53 has been reduced by drawing comb 45 away from torso 17. While not seen in FIG. 2 due to the broken sectioning of flexible ribbon 42, it should be understood by those skilled in the art that the length of ribbon 42 extending outwardly through aperture 40 has been increased during the above-described process of drawing adjustable hair lock 50 inwardly. At this point, the user may make use of the additional length of flexible ribbon 42 to exercise increased freedom of moving comb 45 about hair 15 and hair lock 50 to further style the hair of doll 10. In addition, the additional length of flexible ribbon 42 may, if preferred, be used as a conventional hair tying ribbon and tied in a convenient decorative bowl or the like. Finally, once the styling of hair 15 and adjustable hair lock 40 is complete, comb 45 may be conveniently placed within the desired portion of hair 15 or adjustable hair lock 50 using the engagement of teeth 47 thereof. With temporary reference to FIG. 4, an example of such placement of comb 45 is shown.

It should be noted that, in its normally anticipated fabrication, head 11 is preferably formed of a soft, resilient, molded plastic material or the like. For reasons of economy and ease of a manufacture, head 11 is most likely formed having a relatively thin outer wall or skin and a substantial interior cavity 12. Thus, the friction between hair lock 50 and aperture 52 which is desirable to maintain the position of hair lock 50 at the selected length may cause a substantial drawing force to be applied in the direction indicated by arrow 62 against the upper surface of head 11. This drawing force would, in the absence of head support 30, potentially cause a partial collapse or folding in of the upper portion of doll head 11. Because this is undersirable, the present invention doll includes the cylindrical support member provided by head support 30 which provides a reinforcement of the upper portion of head 11 and avoids such collapse.

Figure 3:
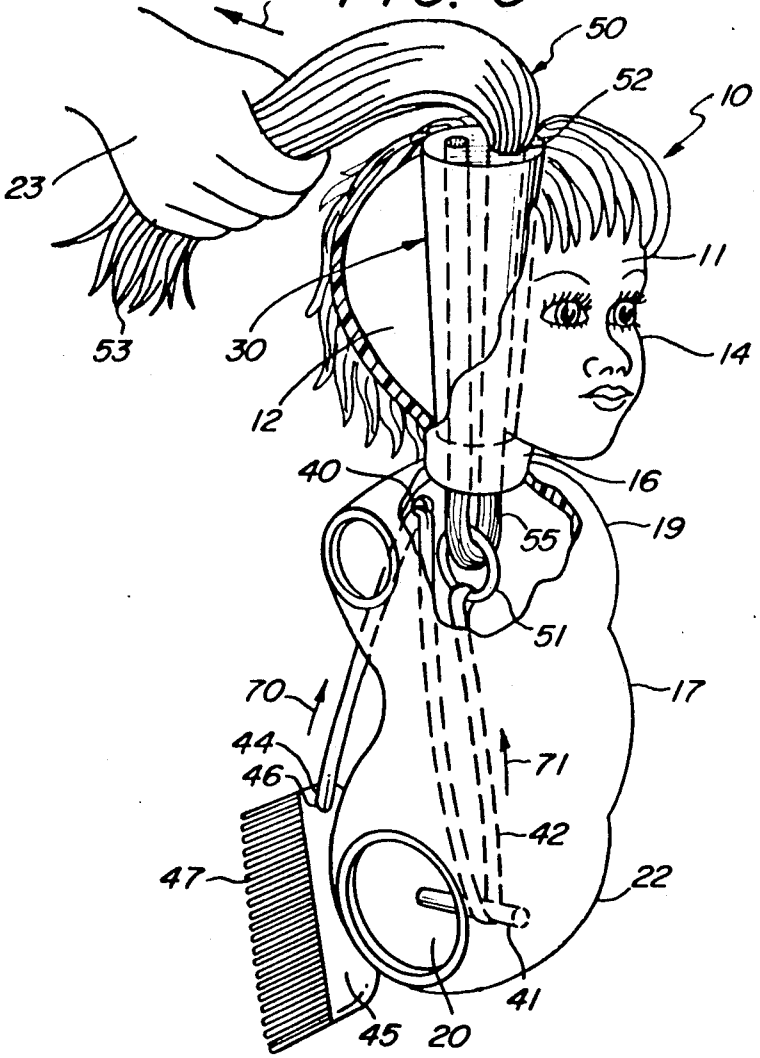
FIG. 3 sets forth a perspective view of the present invention doll in a still further alternate hair configuration.

FIG. 3 sets forth a partially sectioned perspective view of doll 10 showing the operation of withdrawing the desired length of adjustable hair lock 50 from the doll's interior. As set forth above, doll 10 includes a head 11 and a torso 17 coupled by a neck 16. Head 11 defines an interior cavity 12 and a pair of apertures 52 and 54 in the upper portion thereof. A quantity of hair 15 is rooted to head 11 which defines a typical face 14. Torso 17 defines an interior cavity 21, an aperture 40 and a horizontal post 41 disposed therein. An adjustable hair lock 50 defines a free end 53 and a fixed end 56. As described above, adjustable hair lock 50 includes a portion passing through aperture 52 downwardly through interior cavities 12 and 21 forming a loop and terminating in a fixed end 56 secured to aperture 50 of doll head 11. A ring 51 encircles the intermediate portion of adjustable hair lock 50 and is coupled to an end loop 43 of a flexible ribbon 42. Ribbon 42 passes beneath post 41 and upwardly to exit torso 17 at aperture 40. A comb 45 is secured to the remaining end 44 of ribbon 42 using an aperture 46 defined therein. Comb 45 defines a plurality of closely spaced teeth 47. A head support 30 formed of a rigid wall 32 is received within head 11 and provides the above-described support for the upper portion of head 11.

In the position shown in FIG. 3, the user is carrying forward the process of drawing an additional quantity of adjustable hair lock 50 outwardly from head 11. Accordingly, with comb 45 hanging loosely from ribbon 42, the user grasps free end 53 of hair lock 50 using a hand 23 and draws outwardly in the direction indicated by arrow 64. The drawing force in the direction of arrow 64 draws th eintermediate portion of hair lock 50 upwardly and out from head 11 in the direction indicated by arrow 72. This drawing of additional lengths of hair lock 50 outwardly through aperture 52 shortens the intermediate loop of hair lock 50 within head 11 and torso 17 which in turn draws ring 51 and flexible ribbon 42, upwardly within cavity 21 in the direction indicated by arrow 71. The continued outward drawing of hair lock 50 further causes comb 45 to be drawn upwardly as flexible ribbon 42 is drawn through aperture 40 and into interior cavity 21 of torso 17 in the direction indicated by arrow 70. This drawing process continues until ring 51 abuts the interior of neck 16 forming a limit stop on the extent to which hair lock 50 may be withdrawn from head 11.

It will be apparent to those skilled in the art that doll 10 has been shown in FIGS. 1 through 3 in a partially dissassembled form and without arm and leg appendages typical of such dolls to permit the illustration of the present invention adjustable hair length segment.

Figure 4:
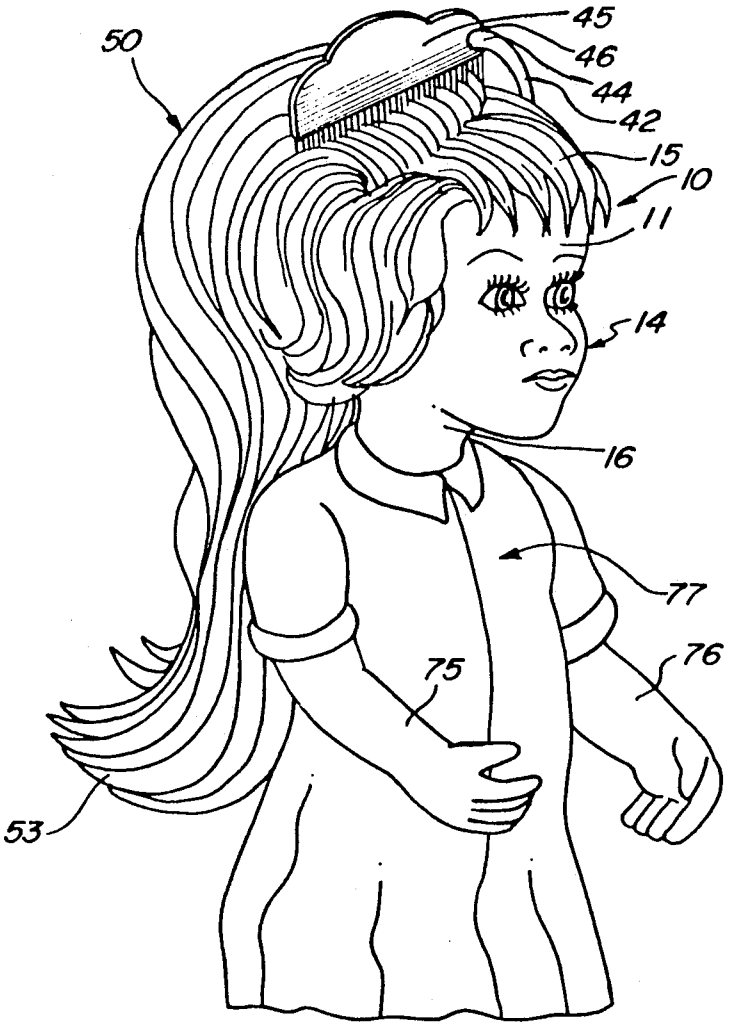
FIG. 4 sets forth perspective view of a doll constructed in accordance with the present invention following hair length adjustment and styling.

FIG. 4 sets forth doll 10 in its completed form in which the appropriate appendages have been added and outer clothing as well as the remainder of hair 15 are shown. Accordingly, as seen in FIG. 4, doll 10 includes arms 75 and 76 secured to torso 17 by conventional fabricaton techniques. In addition, while not shown in FIG. 4, it will be apparent to those skilled in the art that a conventional pair of leg appendages would also be assembled to torso 17 to complete doll 10. A dress 77, constructed in accordance with conventional fabrication techniques, is shown received upon torso 17 and arms 75 and 76. It will be apparent to those skilled in the art that dress 77 must, in order to permit the above-described operation of the present invention, permit flexible ribbon 42 to pass outwardly on the upper back portion of the doll's torso in the manner described. Accordingly, an aperture may be provided in the rear portion of doll 77 or, alternatively, ribbon 42 may be passed outwardly through a convenient opening or neck seam of dress 77. In any event, doll 10 is shown having a full head of hair 15 and a substantial length of adjustable hair lock 50 extending from head 11. In accordance with the above-described use of the present invention, the length of ribbon 42 permits comb 45 to be conveniently placed within hair 15 or adjustable hair lock 50 to provide convenient storage and retention of comb 45.

What has been shown is a simple, effective and inexpensive structure for providing a variable length hair segment for a doll or toy figure. The system shown requires few moving parts and is simple and direct for manipulation by even the youngest of children. In addition, the flexible ribbon drawn to facilitate the present invention variable length hair segment may be used to support a conventional hair comb or other appliance.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll having a hair segment extending therefrom in a variable extension, said doll comprising:

a doll body including a hollow head defining an interior cavity, an interior surface, a first aperture therein and a hollow torso and said body defining a second aperture therein;

a hair segment having a first end secured in a fixed attachment to said interior surface within said interior cavity proximate said first aperture, a second end external to said doll body and an intermediate portion within said hollow head and torso extending from said fixed first end to form an internal loop within said torso and through said first aperture in a single direction; and a flexible draw member having a first end coupled to said intermediate portion of said hair segment extending outwardly from said doll body through said second aperture therein and defining a second end, said flexible draw member being withdrawable from said doll body to increase the length of said intermediate portion of said hair segment and decrease the length of said second end of said hair segment external to said doll body.

2. A doll as set forth in claim 1 wherein said intermediate portion of said hair segment forms a loop extending downwardly within said hollow head and torso.

3. A doll as set forth in claim 2 wherein said draw member includes a ring encircling said loop of said intermediate portion of said hair segment and wherein said first end of said draw member is attached to said ring.

4. A doll as set forth in claim 3 wherein said torso includes a post disposed within said hollow torso and wherein said flexible draw member passes downwardly from said ring, beneath said post, and upwardly and outwardly through said second aperture in said doll body.

5. A doll as set forth in claim 4 wherein said second aperture in said doll body is defined in said torso.

6. A doll as set forth in claim 5 further including a cylindrical support member captivated within said hollow head defining a passage therethrough which said intermediate portion extends.

7. A doll as set forth in claim 5 further including a comb coupled to said second end of said draw member.

8. A doll comprising:

a head defining a first interior cavity, an interior surface, a neck portion and an upper aperture;

a torso coupled to said neck portion and defining a second interior cavity, a rear aperture, and a guide member;

a hair segment having an intermediate portion having a cross section generally filling said upper aperture and extending downwardly through upper aperture in said head in a single direction into said second cavity and upwardly through said second interior to form a pair of hair segment portions and a loop within said second interior cavity, a fixed end secured to said interior surface of said head, and a free end external to said first and second cavities;

a tubular support member extending downwardly from said interior surface of said head through said first interior cavity and surrounding a portion of said pair of hair segment portions;

a ring coupled to said loop; and a flexible draw ribbon having a first end coupled to said ring and a second end, said draw ribbon extending from said ring about said guide member and outwardly through said rear aperture.

9. A doll as set forth in claim 8 wherein said fixed end of said hair segment is secured directly to said interior surface of said head within said first cavity proximate said first aperture within said tubular support member.

10. A doll as set forth in claim 9 wherein said guide member includes a post supported within said second cavity.

11. A doll as set forth in claim 10 wherein said guide member includes a limit stop interfering with the motion of said ring beyond said post.

12. A doll as set forth in claim 10 wherein said fixed end is secured to said head adjacent said upper aperture in an adhesive attachment.

13. A doll as set forth in claim 12 wherein said torso is formed by molding and defines a lower portion and wherein said guide member is positioned in said lower portion and integrally molded with said torso.

14. A doll comprising:

a hollow body including a hollow torso and a head defining an interior cavity, an interior surface and an upper aperture;

a length of hair extending through said upper aperture in a single direction into said hollow body to form a fixed internal end secured to said interior surface, an internal loop extending through said interior cavity and an external end extending from said upper aperture; and draw means within said hollow torso, coupled to said internal loop to change the length of said internal loop, said draw means including a flexible ribbon for pulling said internal loop to draw a portion of said external end into said head to lengthen said internal loop.

* * * * *